US007140689B2

(12) United States Patent
Zheng

(10) Patent No.: US 7,140,689 B2
(45) Date of Patent: Nov. 28, 2006

(54) COLLAPSIBLE CHAIR WITH BACKREST ROD ANCHOR

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 197 days.

(21) Appl. No.: 10/841,932

(22) Filed: May 6, 2004

(65) Prior Publication Data

US 2005/0248202 A1 Nov. 10, 2005

(51) Int. Cl.
*A47C 7/00* (2006.01)
*A47C 4/28* (2006.01)

(52) U.S. Cl. ..... 297/440.11; 297/45

(58) Field of Classification Search ..... 297/440.21, 297/440.11, 45, 452.13
See application file for complete search history.

(56) References Cited

U.S. PATENT DOCUMENTS 6,247,748 B1 * 6/2001 Zheng ..... 297/16.2

FOREIGN PATENT DOCUMENTS

EP 0139306 * 5/1985

* cited by examiner

*Primary Examiner*—Milton Nelson, Jr.
(74) *Attorney, Agent, or Firm*—Rutan & Tucker, LLP

(57) ABSTRACT

A collapsible chair having a backrest, at least one backrest support rod, and a backrest rod anchor coupling the backrest to the backrest support rod, wherein the backrest rod anchor comprises a rod end receiving portion coupled to a backrest attachment portion, the backrest support rod is at least partially enclosed by the rod end receiving portion of the backrest rod anchor, and the backrest is attached to the backrest attachment portion of the backrest rod anchor.

16 Claims, 6 Drawing Sheets

FIG. 1A
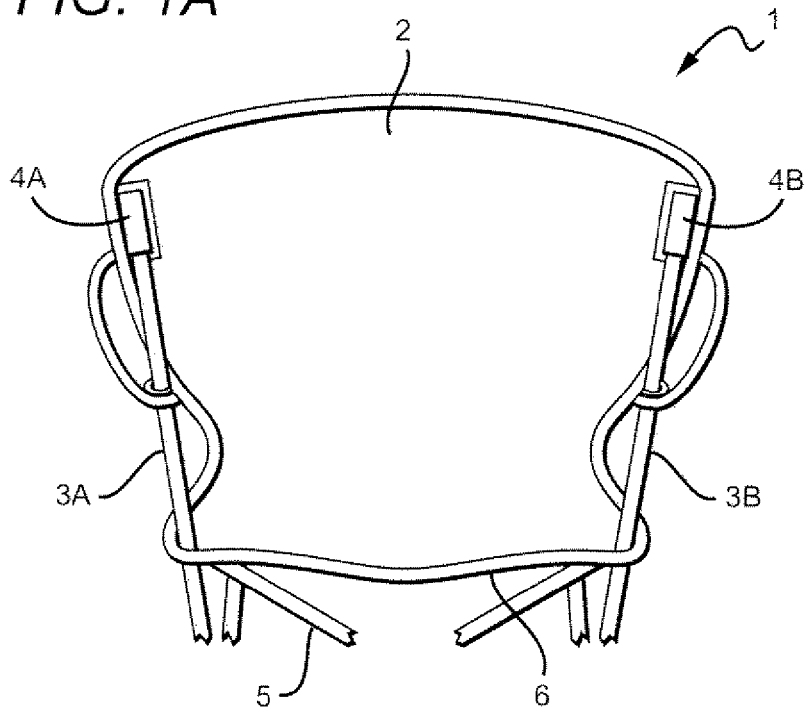
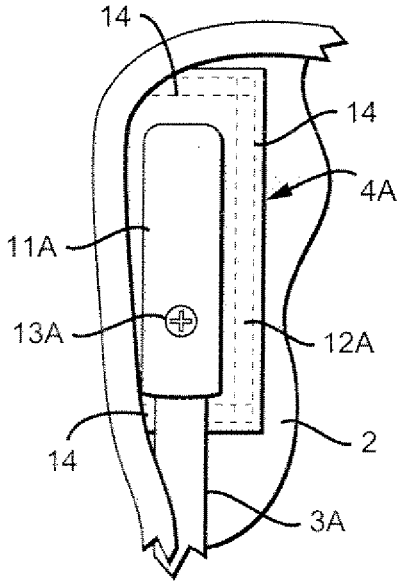
FIG. 1B
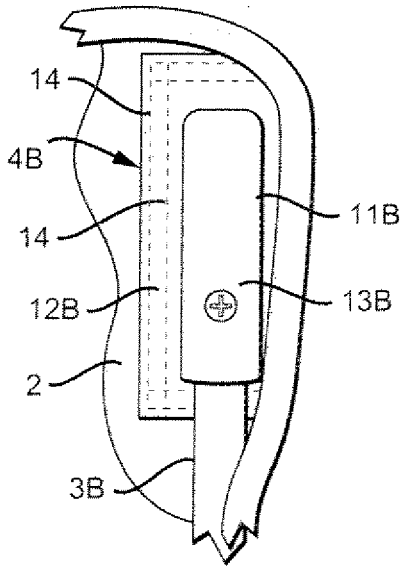
FIG. 1C

FIG. 3A
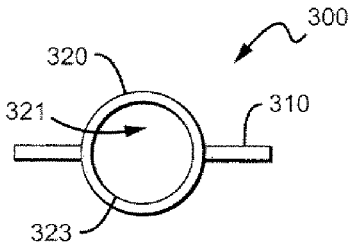
FIG. 4A
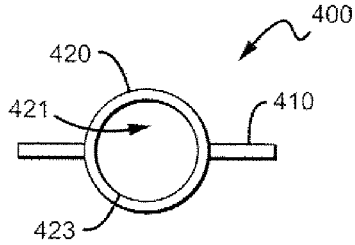
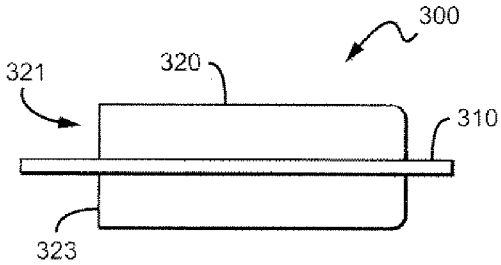
FIG. 3B
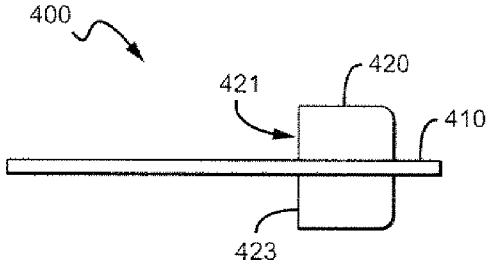
FIG. 4B
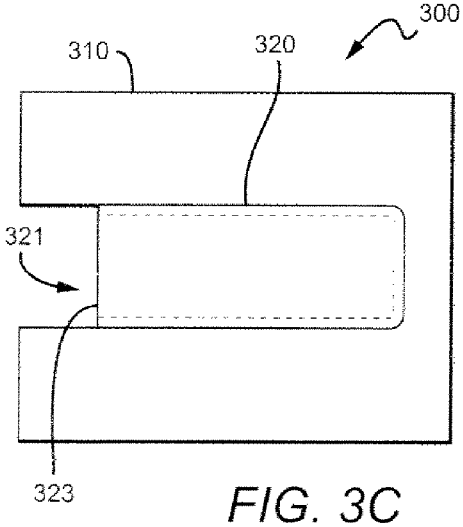
FIG. 3C
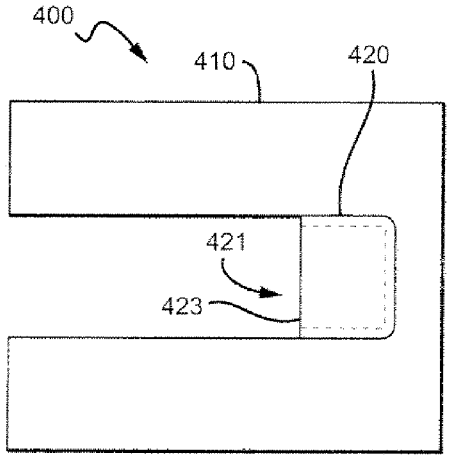
FIG. 4C FIG. 5A
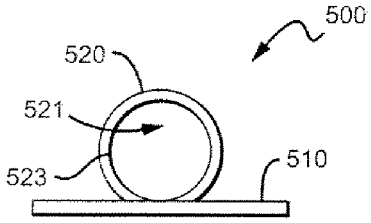
FIG. 6A
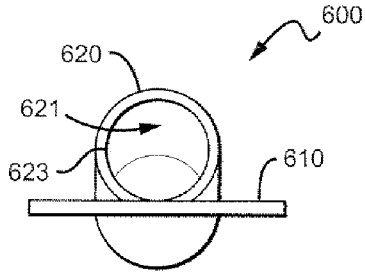
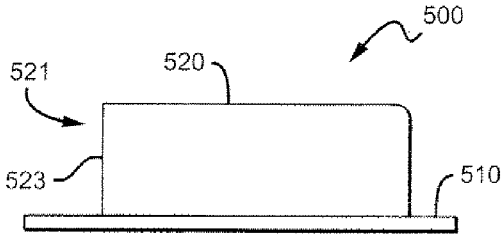
FIG. 5B
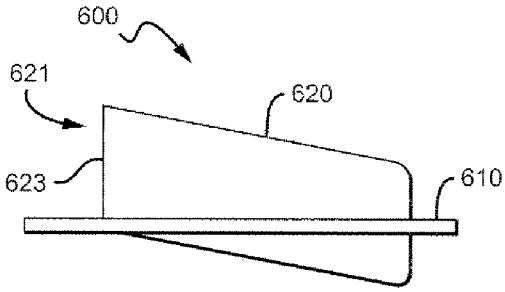
FIG. 6B
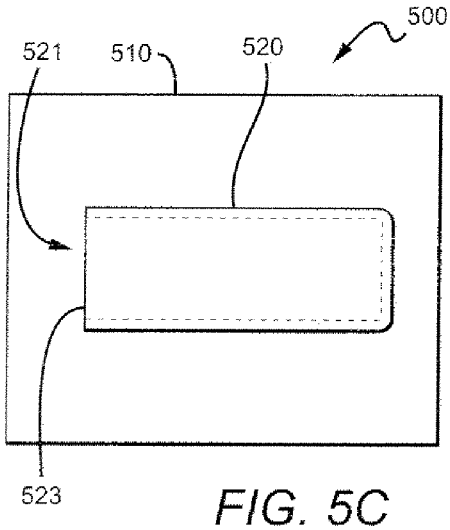
FIG. 5C
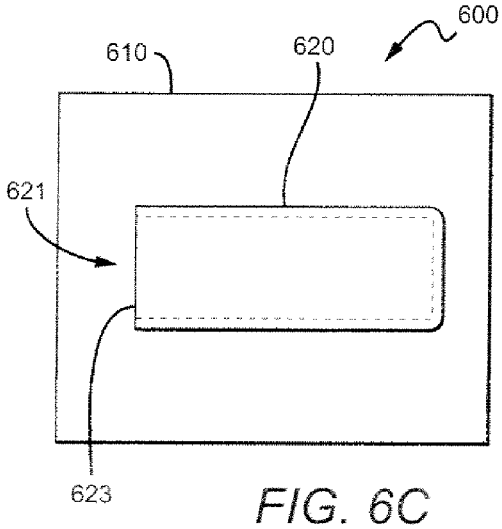
FIG. 6C FIG. 9A
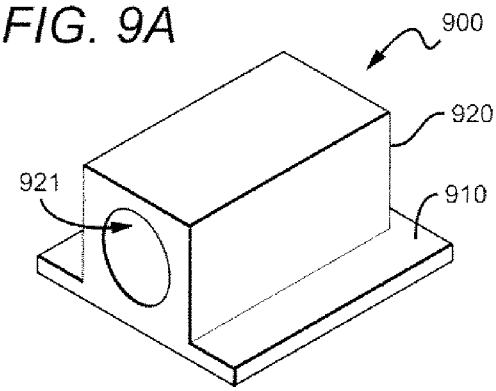
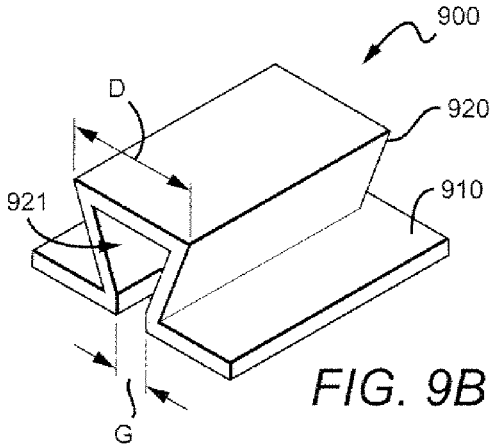
FIG. 9B
FIG. 9C
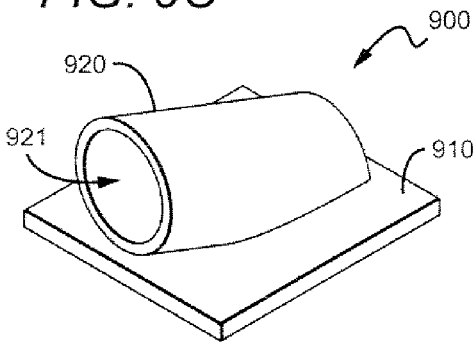
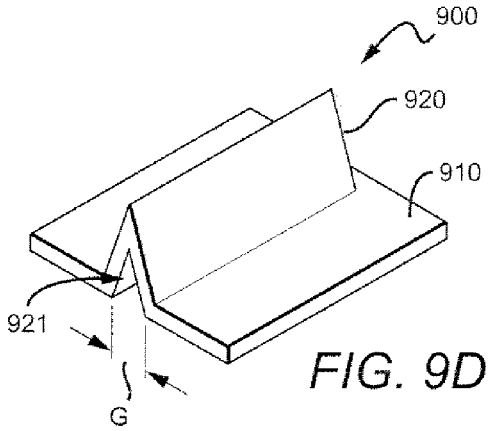
FIG. 9D
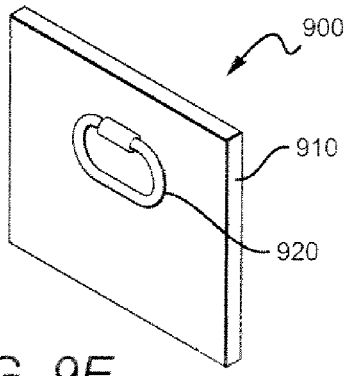
FIG. 9E

COLLAPSIBLE CHAIR WITH BACKREST ROD ANCHOR

FIELD OF THE INVENTION

The field of the invention is collapsible furniture.

BACKGROUND OF THE INVENTION

Flaccid back chairs, as used herein, are chairs having a backrest formed from a material or combination of materials that crumple, fold or bend and which provide support by being combined with a pair of support rods or some other support structure having members substantially more rigid than the backrest. A common example of a flaccid back chair is a collapsible chair having a fabric backrest stretched between two vertical support rods. Numerous other examples of flaccid back chairs can be found by referring to the chairs described in the set of U.S. patents in class 295, subclass 47, each of which is incorporated herein by reference in its entirety.

In some instances, the backrest portion of a flaccid back chair hangs from a cross member that extends horizontally across the back of the chair, while in other instances the backrest portion slides onto the ends of two or substantially more vertical support rods. Such vertically supported flaccid back chairs are of particular interest because of a tendency for the backrest to suffer damage at the point of contact between the ends of such vertical support rods and the backrest, and because of inefficiencies of known methods of producing such chairs.

In many instances such vertical support rods are coupled to a backrest by forming elongated pockets in the backrest, and sliding the ends of the support rods into the pockets. It is important to note that forming the pockets substantially increases the time required to form the chair. As such, methods of forming flaccid back chairs that provide a faster alternative to the use of cloth pockets are desirable.

It is also important to note that if one leans on or otherwise pushes down on a center portion of the backrest of such a vertically supported flaccid backed chair, one is essentially forcing the ends of the support rods against the top of the pockets. Doing so has a tendency to cause excessive wear on the seams of the pocket, and/or on the material from which the pocket is formed. As such, it is desirable to utilize a method of supporting a backrest that results in less wear when downward pressure is applied to a center portion of the backrest. In response, The following disclosure provides for methods and apparatus that increase durability and reduce production time of flaccid backed chairs.

SUMMARY OF THE INVENTION

The present invention is directed to flaccid back chairs, particularly freely collapsible chairs, that have a backrest coupled to one or more backrest support rods via one or more backrest support rod anchors.

In one aspect of the inventive subject matter, a collapsible chair comprises a backrest, at least one backrest support rod, and a backrest rod anchor coupling the backrest to the backrest support rod, wherein the backrest rod anchor comprises a rod end receiving portion coupled to a backrest attachment portion, the backrest support rod is at least partially enclosed by the rod end receiving portion of the backrest rod anchor, and the backrest is attached to the backrest attachment portion of the backrest rod anchor.

In another aspect of the inventive subject matter, the backrest and backrest rod anchor are coupled by stitching the backrest and backrest rod anchor together where such stitching is positioned on and passes through the backrest attachment portion of the backrest rod anchors. In preferred chairs, such stitching will extend around the perimeter of the anchor.

In yet another aspect of the inventive subject matter, the backrest rod anchor and backrest support rod are coupled by sliding an end of the backrest support rod into a cavity of the backrest rod anchor. In some instances the cavity may be substantially shorter than the overall length of the anchor. In other instances the cavity may comprise an elongated gap that is narrower than the cavity itself such that the anchor can be coupled to the rod by pushing the anchor onto the rod by forcing the rod through the gap. The cavity may be shaped to conform to the shape of the portion of the backrest support rod it is intended to receive.

In still further contemplated aspects of the inventive subject matter, a collapsible chair includes a fastener fastening the backrest rod anchor to the backrest support rod in a manner that inhibits movement of the backrest support rod anchor relative to the backrest support rod. In some instances the fastener may comprise a screw fastening the anchor to the rod.

In another aspect of the inventive subject matter, a method of forming a chair having a flaccid backrest, two backrest rod anchors, and two backrest rods comprises providing the backrest, two rod anchors, and two backrest rods, sewing the backrest rod anchors onto the backrest, sliding one backrest rod into each of the backrest rod anchors, and fastening each rod anchor to the backrest rod within it. In some instances such a method may also include using one or more screws to fasten each rod anchor onto a backrest rod.

A collapsible chair, as the term is used herein, includes a seat coupled to one or more seat support rods, a backrest coupled to one or more backrest support rods, and the chair can be collapsed such that it can be contained in a smaller volume when collapsed than when it is not collapsed. Of particular interest are collapsible chairs that collapse in a single movement. As used herein, the term "collapses in a single movement" or "collapses in a single motion" are used interchangeably and refer to a movement in which a user need not interrupt the collapsing motion to fasten or unfasten a connector. Thus, the term "collapses in a single movement" may also include multiple sub-movements, which may or may not be separated by a pause. The term "freely collapsible chair" is used hereinto refer to a collapsible chairs which can be collapsed in a single motion.

It is contemplated that the teachings provided herein are particularly well suited for use with chairs having features described in various predecessor patents and co-pending applications, including application Ser. No. 10/433,703 filed Jun. 3, 2003; Ser. No. 10/469,924 filed Sep. 2, 2003; Ser. No. 10/416,078 filed Oct. 20, 2003; Ser. No. 10/469,462 filed Feb. 9, 2004; and Ser. No. 10/301,059 filed Nov. 20, 2002.

Each referenced patent and patent application is hereby incorporated by reference in its entirety, and it should be appreciated that the limitations of any claims provided therein may be combined in any manner with the claims herein, with each such combination being one of the many embodiments contemplated herein.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1A is a back perspective view of a collapsible chair embodying the invention.

FIG. 1B is a detail view of the left backrest rod anchor of the chair of FIG. 1A.

FIG. 1C is a detail view of the right backrest rod anchor of the chair of FIG. 1A.

FIG. 3A is a bottom view of a backrest rod anchor.

FIG. 3B is a side view of the anchor of FIG. 3A.

FIG. 3C is a back view of the anchor of FIG. 3A.

FIG. 4A is a bottom view of a backrest rod anchor.

FIG. 4B is a side view of the anchor of FIG. 4A.

FIG. 4C is a back view of the anchor of FIG. 4A.

FIG. 5A is a bottom view of a backrest rod anchor.

FIG. 5B is a side view of the anchor of FIG. 5A.

FIG. 5C is a back view of the anchor of FIG. 5A.

FIG. 6A is a bottom view of a backrest rod anchor.

FIG. 6B is a side view of the anchor of FIG. 6A.

FIG. 6C is a back view of the anchor of FIG. 6A.

FIG. 9A depicts an alternative backrest support rod anchor.

FIG. 9B depicts an alternative backrest support rod anchor.

FIG. 9C depicts an alternative backrest support rod anchor.

FIG. 9D depicts an alternative backrest support rod anchor.

FIG. 9E depicts an alternative backrest support rod anchor.

DETAILED DESCRIPTION

Figure 2A:
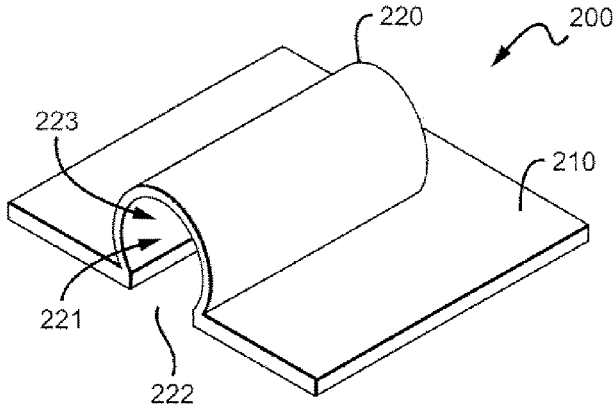
FIG. 2A is a perspective view of a backrest rod anchor.

In FIG. 1, an exemplary freely collapsible chair 1 has a backrest 2 supported by backrest support rods 3A and 3B via backrest support rod anchors 4A and 4B, as well as a seat 6, and legs which are part of a supporting framework 5. Backrest 2 is made of a flaccid, clothlike material that folds and/or crumples when chair 1 is collapsed.

In FIG. 1B, anchor 4A is shown in additional detail wherein it can be seen to comprise a rod end receiving portion 11A coupled to a backrest attachment portion 12A. Anchor 4A had been stitched/sewn to backrest 2 via stitching 14, slid onto the end of rod 3A, and fastened to the end of rod 3A via a screw fastener 13A. Similarly, in FIG. 1C anchor 4B is shown in additional detail wherein it can be seen to comprise a rod end receiving portion 11B coupled to a backrest attachment portion 12B. Anchor 4B has been stitched/sewn to backrest 2 via stitching 14, slid onto the end of rod 3B, and fastened to the end of rod 3B via a screw fastener 13B.

Anchors 4A and 4B may be formed from any material or combination of materials being substantially stiffer than backrest 2. In some embodiments anchors may be formed from leather or some other flexible material while in other they may be formed from a substantially rigid plastic or metal. However, all materials are deemed suitable for use herein where such materials include but are not necessarily limited to metals (e.g., aluminum, iron, etc.), metal alloys, carbon, synthetic polymers (e.g., HDPE, PVC, etc.), and all reasonable combinations thereof.

Although shown stitched to backrest 2, in alternative embodiments anchors 4A and 4B may be coupled to backrest 2 in any other reasonable manner. Exemplary but non-exhaustive examples include the use of an adhesive to couple the anchors to the backrest and/or the use of fasteners such as rivets.

Similarly, anchors 4A and 4B may be coupled to rods 3A and 3B in any reasonable manner, although having the anchors first pushed onto the rods and the fastened with a screw is the currently preferred manner. Alternative methods of coupling may include but are not necessarily limited to the use of multiple fasteners, different types of fasteners, and the use of adhesives. In some instances anchors may be self adhering in that, once they have been pushed onto the rods, they are heated/cooled or otherwise treated or allowed to change state such that they are more difficult to remove than they were to put on.

The seat 6 and the backrest 2 are preferably fabricated from a weather resistant material, preferably a woven synthetic polymer (e.g., Nylon) that is uniformly colored (e.g., blue). Particularly preferred seats have a width of about 21 inches and an overall length of about 24 inches. However, it should be appreciated that various alternative materials, colors, and sizes are also appropriate. Examples of alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, or no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 21 inches, and suitable widths include 21–24, 24–30, and 30–40 inches, and wider, but also 18–21, 14–18, and 8–14 inches, and narrower. Likewise, the length of appropriate seats may vary between 20–42, 15–10, and 12–15 inches and less, but also between 24–27, 27–30, and more. It should further be appreciated that contemplated seats may also be tapered from the front end to the back end, or vice versa.

With respect to the backrest it is contemplated that the backrest is fabricated from the same material as the seat, and that the backrest is removably or permanently coupled to the seat (e.g., sewed, coupled with a zipper, etc.). Thus, it is preferred that the backrest has a width of about 21 inches. A preferred height of the backrest is about 18 inches. With respect to the material and color, it is contemplated that the same considerations as for the seat apply. It is further contemplated that the width and height of suitable backrests may vary, and that width and height will depend among other things on the person's size and the number of persons to be seated in the chair. Thus, alternative backrests may have a width between 18–12 inches and less, but also between 18–22 and more. Similarly, contemplated backrests may have a height between 12–18 inches and less, but also between 18–25 inches and more.

It is generally contemplated that the seat and the backrest (in addition to the use of anchors as described herein) may be coupled to various support members in numerous ways, including temporary and permanent couplings. Temporary couplings include hook-and-loop type fasteners, snaps, buckles, slidable elements (e.g., a pouch slidably coupled to a post, a ring slidably coupled to a rod, etc.), and threadably securable elements (e.g., laces threaded through rings). Permanent couplings include sewed or glued elements.

It should further be appreciated that the attachment of the seat and/or the backrest (in addition to the use of anchors as described herein) to the chair may be directly or indirectly attached. As used herein, the term "direct" attachment means that the seat and/or the backrest are in immediate contact with the supporting structure, whereas the term "indirect" means that an additional element connects the seat and/or backrest with the supporting structure. For example, the seat may be directly attached to the seat support rods via a slidable pouch. Alternatively, the seat may be indirectly coupled to the seat support rods via a ring-shaped opening in the seat that slidably engages with the rods. Yet another alternative is the use of anchors as described herein in relation to the backrest to couple the seat to the seat support rods.

With respect to the backrest support rods and any other support elements of contemplated chairs, it should be appreciated that all of these elements may be manufactured from various materials, including metals, metal alloys, natural and synthetic polymers, and any reasonable combination thereof. However, it is preferred that the support rods and any legs, seat support rods, and cross braces are manufactured from black anodized aluminum tubing with a wall strength of about 1/32 inch and an outer diameter of approximately ½ inch. Preferred alternative materials include stainless steel, fiberglass, and wood. It should also be noted that the backrest support rods may perform multiple functions as in chair 1 where they provide support to the backrest while also act as two legs of the supporting framework 5.

Where one support member is pivotably coupled to another support member, it is generally contemplated that all known manners of rotatably coupling are suitable for use in conjunction with the teachings presented herein. For example, appropriate manners of rotatably coupling include coupling of two elements via a common axis, coupling via a hinge wherein the hinge may or may not have a slidable connection to another element, coupling via a ball bearing, etc. Similarly, where one support member is slidably coupled to another support member, all known slidable couplings are contemplated to be appropriate, and include a sliding sleeve, slide rails, guiding rings, etc.

Furthermore, it should be appreciated that the coupling may vary depending on the particular configuration of contemplated chairs. For example it is contemplated that all of the couplings may be rotatable and slidable. Alternatively, where slidable couplings are less desirable, alternative couplings may be employed and suitable couplings especially include temporary couplings such as snap connectors, connectors that are secured with a pin or other removable element, etc. In still further alternative aspects of the inventive subject matter, the coupling may be done via an intermediate rod, that rotatably couples two elements together.

Figure 2B:
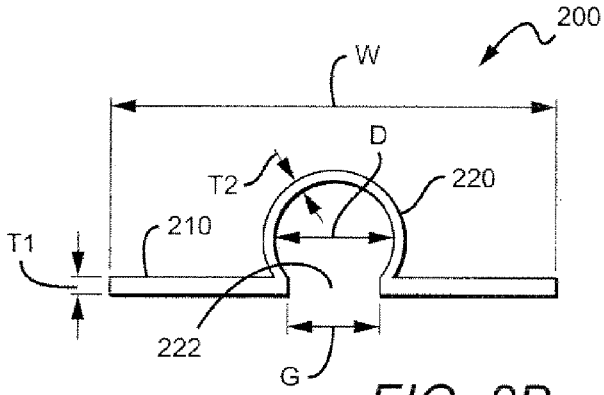
FIG. 2B is a bottom view of the anchor of FIG. 2A.
Figure 2C:
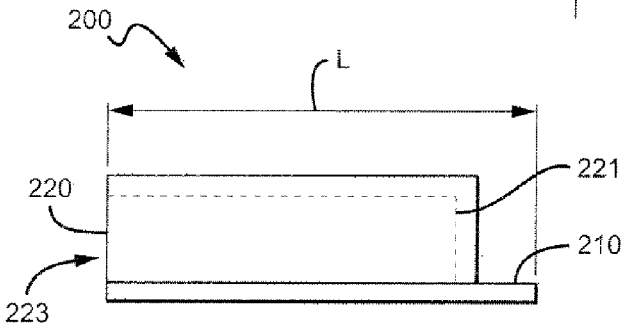
FIG. 2C is a side view of the anchor of FIG. 2A.

In FIGS. 2A–2C, a backrest rod anchor 200 comprises a rod end receiving portion 220 coupled to a backrest attachment portion 210, and a rod receiving cavity 221 having a gap 222 along its length and an open end 223. Anchor 200 has a width W and a length L, gap 222 has a width G, cavity 221 has a diameter D, portion 210 has a thickness T1, and portion 220 has a thickness T2. The values for W, L, G, D, T1, and T2 will vary for different anchors. However, currently preferred anchors have a width W that is at least two times the diameter D, and possibly three, four, or more times the diameter D, and a length L that is at least three times the diameter D, and possibly four, five, or more times the diameter D. The thickness T2 will vary at least in part depending on the choice of materials for anchor 200 and the intended use of any chairs it is to be incorporated in. For many embodiments T2 will be 1 to 4 millimeters thick. T1 will vary in a similar fashion but will likely also vary depending on the intended method of coupling anchor 200 to a backrest. As such, if anchor 200 is to be sewn onto a backrest without the use of preformed holes, thickness T1 must be sufficiently small to allow a needle or similar device to pierce the attachment portion 210. In contrast, thickness T1 may be significantly greater if anchor portion 210 comprises pre-drilled holes or if an adhesive is to be used to couple anchor 200 to a backrest. Diameter D will generally be chosen based on the external diameter of the backrest support rod the anchor is to receive in cavity 221. The gap width G will typically depend in part on the type of material used to form the anchor and the diameter or width of the backrest support rod that the anchor is to be used with. In preferred embodiments the gap will be sufficiently wide to permit a backrest support rod to be pushed through the gap 222 and into cavity 221 but to require sufficient force for doing so that the rod will not easily slip back out of the cavity.

In FIGS. 3A–3C a backrest rod anchor 300 comprises a rod end receiving portion 320 coupled to a backrest attachment portion 310, and a rod receiving cavity 321 having an open end 323. Backrest rod anchor 300 will generally be dimensioned as described in relation to anchor 200. Anchor 300 differs from anchor 200 in that anchor 300 is not "gapped", i.e. does not have a gap extending along the length of cavity 321, and in that the receiving portion 320 is positioned such that it protrudes from both sides of portion 310, and would likely protrude from both the front and back of any backrest it is attached to due to the tendency of a flaccid backrest to conform to the shape of the anchor.

In FIGS. 4A–4C a backrest rod anchor 400 comprises a rod end receiving portion 420 coupled to a backrest attachment portion 410, and a rod receiving cavity 421 having an open end 423. Backrest rod anchor 400 will generally be dimensioned as described in relation to anchor 200. As with anchor 300, anchor 400 is not a gapped anchor. Anchor 400 differs from anchor 300 in that the receiving portion 420 is substantially shorter than portion 410 where anchor 300 has a receiving portion that extends along most of the length of portion 310.

In FIGS. 5A–5C a backrest rod anchor 500 comprises a rod end receiving portion 520 coupled to a backrest attachment portion 510, and a rod receiving cavity 521 having an open end 523. Backrest rod anchor 500 will generally be dimensioned as described in relation to anchor 200. As with anchors 300 and 400, anchor 500 is not a gapped anchor. However, anchor 500 is similar to gapped anchor 200 in that it is adapted to position a support rod on one side of portion 510 and thus facilitates the positioning of the support rod on one side of a backrest.

In FIGS. 6A–6C a backrest rod anchor 600 comprises a rod end receiving portion 620 coupled to a backrest attachment portion 610, and a rod receiving cavity 621 having an open end 623. Backrest rod anchor 600 will generally be dimensioned as described in relation to anchor 200. As with anchors 200 and 500, anchor 600 is not a gapped anchor. However, anchor 600 differs from anchors 200–500 in that the receiving portion 620 is angled relative to attachment portion 610. Angling the receiving portion relative to the attachment portion facilitates having support rods approach the backrest at an angle without having to form bends in the support rods or forming an unwanted fold in the backrest. As with anchors 300 and 400, the receiving portion 620 of anchor 600 extends through attachment portion 610. In alternative embodiments, it is contemplated that the receiving portion may be angled, but still be positioned on one side of the attachment portion. An example of such an embodiment is shown in FIG. 9C.

It is contemplated that anchors 200, 500, and 600 may be advantageous over anchors 300 and 400 as they have backrest attachment portions that extend around the entire perimeter of the anchor. As such, the entire perimeter of the anchor can be used to couple the anchor to the backrest and thus maximize the area over which any load will be distributed.

Figure 7A:
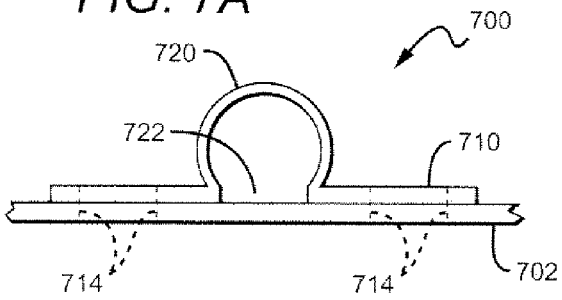
FIG. 7A depicts a first method for coupling an anchor to a single layer of a backrest.
Figure 7B:
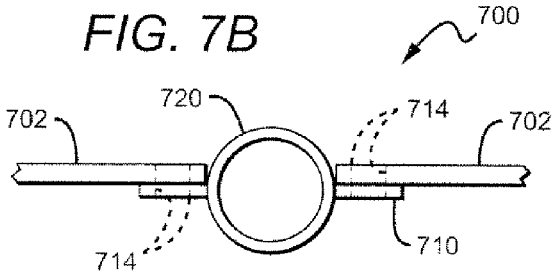
FIG. 7B depicts a second method for coupling an anchor to a single layer of a backrest.
Figure 7C:
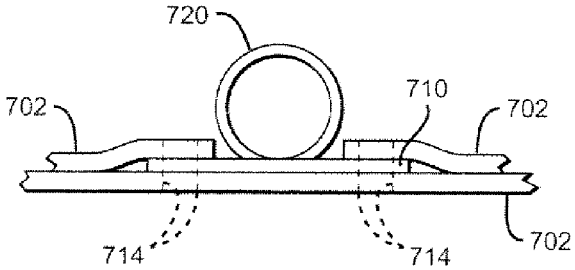
FIG. 7C depicts a first method for coupling an anchor to multiple layers of a backrest.
Figure 7D:
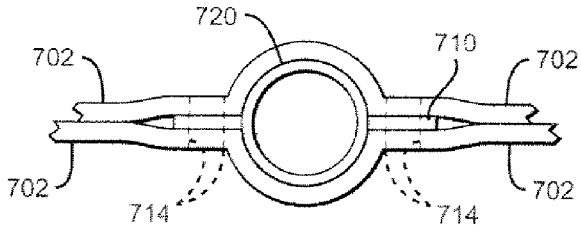
FIG. 7D. depicts a second method for coupling an anchor to multiple layers of a backrest.

FIGS. 7A–7C depict a few of the many possible way of coupling an anchor to a backrest to for an assembly 700 where the anchor comprises a rod end receiving portion 720 coupled to a backrest attachment portion 710, and the backrest attachment portion 710 is stitched with stitching 714 to one or more layers 702 of a backrest. As shown in FIG. 7A, if the anchor comprises a gap 722 such as was described in relation to FIGS. 2A–2C, backrest 702 may extend across the gap to help form the cavity into which a support rod will be received, and to help retain the rod within the cavity. It is contemplated that retention of the rod will come in part from completing the cavity wall, and may in part come from preventing the gap 722 from being temporarily widened if backrest 702 does not stretch easily. As shown in FIGS. 7A, 7C and 7D, a particular layer 702 of a backrest may extend across the width of an anchor, or as illustrated in FIGS. 7B and 7C, may comprise one or more pieces that extend only partially across an anchor. It is contemplated that utilizing a single layer that extends across the entire width of the anchor will in many instances prove advantageous.

It should be noted by comparing FIGS. 7A and 7C to FIGS. 7B and 7D that the type of anchor used impacts the position of a support rod relative to the backrest such that the rod can be positioned on either side of the backrest, or can be positioned such that it protrudes outwards from both the front and the back of a backrest. In preferred embodiments, the anchor is used to position the support rod behind the back rest such that it does not extend outward from the side of the backrest that a person sitting in a chair would be leaning against.

Figure 8:
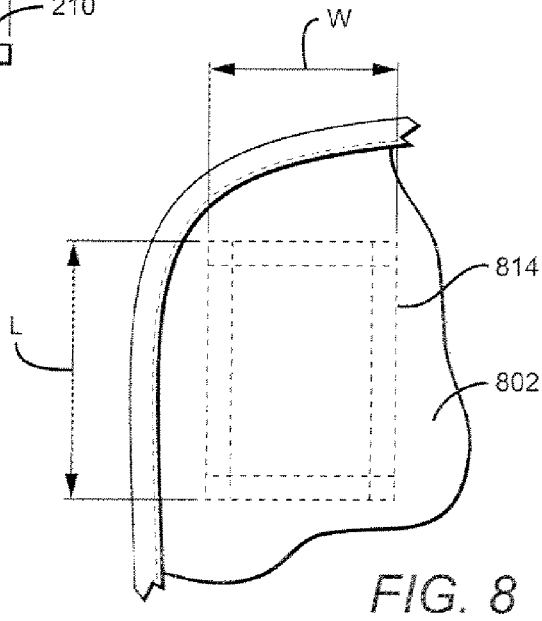
FIG. 8 depicts the front of the backrest opposite a backrest support rod anchor.

FIG. 8 illustrates one method of stitching a backrest to an anchor where the anchor positions the backrest support bar behind the backrest. As shown, preferred chairs will have the anchors coupled to the backrest in a manner designed to maximize the area of contact between the anchor and the backrest. As such, in FIG. 8, the "footprint" of the anchor, i.e. the area defined by the points at which the anchor is fastened to the backrest, has a width W and length L equal to the width and length of the anchor because the stitching 814 follows the perimeter of the anchor. It should be apparent that stitching along the perimeter generally obtains the maximum footprint size that can be achieved for a particular anchor. In FIG. 8 the footprint is substantially rectangular and has 4 horizontal segments and two vertical segments. However, any reasonable footprint shape and/or stitching patter may be used such that alternative embodiments may have footprints/patters than are circular, triangular, or some other shape.

Although the footprint area of particular embodiments of anchors will vary, it is contemplated that anchors having an area of 4 to 15 square inches may prove advantageous.

FIGS. 9A–9E illustrate a small number of the numerous alternative embodiments contemplated. Although other variations and/or combinations are contemplated, the anchors 900 of FIGS. 9A–9E each comprise a rod end receiving portion 920 coupled to a backrest attachment portion 910. As illustrated by FIG. 9A, an anchor need not have the external shape of the rod end receiving portion match the shape of the cavity 921. As illustrated by FIGS. 9A–9E, not all rod end receiving portions need have a cylindrical exterior. FIG. 9B also illustrates an anchor having a "gapped" cavity similar to the anchor of FIGS. 2A–2C where the gap width G is smaller than the width/diameter D of some other portion of the cavity. FIG. 9C illustrates a rod end receiving portion 920 and cavity 921 that are not parallel to the backrest attachment portion 910, and an anchor where the point of contact between the portions 910 and 920 is less then the length of the portion 920. FIG. 9D illustrates an anchor wherein the gap width G is at least as large as the width/diameter of every other portion of the cavity. FIG. 9E illustrates an alternative form of rod end receiving portion 920 which comprises a ring (which could be any type of fastener) to fasten a support rod to the backrest attachment portion of the anchor.

Thus, specific embodiments and applications of collapsible chairs have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair comprising a backrest, at least one backrest support rod, and a backrest rod anchor coupling the backrest to the backrest support rod, wherein:

the backrest rod anchor comprises a rod end receiving portion coupled to a backrest attachment portion;

the backrest support rod is at least partially enclosed by the rod end receiving portion of the backrest rod anchor, and the backrest support rod is coupled to the rod end receiving portion by a fastener;

the backrest is attached to the backrest attachment portion of the backrest rod anchor; and wherein the backrest rod anchor comprises a material other than the backrest, wherein the backrest anchor material is stiffer than the backrest.

2. The chair of claim 1 wherein the backrest comprises a flaccid material selected from the group consisting of a woven synthetic polymer, a natural fabric, and a synthetic fabric.

3. The chair of claim 1 comprising an optionally removable fastener.

4. The chair of claim 1 wherein the backrest and backrest rod anchor are sewn together.

5. The chair of claim 1 wherein the rod end receiving portion comprises a cavity having a non-cylindrical shape, and the backrest support rod is at least partially enclosed within the cavity.

6. The chair of claim 1 wherein the rod end receiving portion comprises a preformed cavity shaped to match the shape of a portion of the backrest support rod, and wherein the backrest support rod is at least partially enclosed within the cavity.

7. The chair of claim 6 wherein the backrest rod anchor is elongated and the cavity extends along only a portion of the length of the rod anchor.

8. The chair of claim 6 wherein the backrest extends across an elongated gap in a wall of the cavity.

9. The chair of claim 8 wherein the gap is narrower than the diameter of the cavity.

10. The chair of claim 1 wherein the backrest and the backrest rod anchor are coupled together at points around the entire perimeter of the attachment portion of the backrest rod anchor.

11. The chair of claim 10 comprising stitching extending around the perimeter of the backrest rod anchor, the stitching coupling the backrest rod anchor to the backrest.

12. The chair of claim 11 wherein the stitching comprises at least two horizontal segments and at least two vertical segments.

13. A collapsible chair comprising a flaccid backrest sewn to each of at least two backrest support rod anchors wherein each of the two backrest support rod anchors is coupled to a corresponding one of at least two backrest support rods by having the corresponding backrest support rod at least partially within a cavity of the backrest rod anchor, wherein a fastener retains the respective backrest support rod within the cavity, wherein the backrest rod anchor comprises a material other than the backrest, and wherein the backrest anchor material is stiffer than the backrest.

14. A method of forming a chair having a flaccid backrest, two backrest rod anchors, and two backrest rods comprising:

providing the backrest, two rod anchors, and two backrest rods;

sewing the backrest rod anchors onto the backrest; sliding one backrest rod into each of the backrest rod anchors, and fastening each rod anchor to the backrest rod within it; and wherein the backrest rod anchor comprises a material other than the backrest, and wherein the backrest anchor material is stiffer than the backrest.

15. The method of claim 14 wherein fastening each rod anchor comprises using one or more screws to fasten each rod anchor onto a backrest rod.

16. The method of claim 14 wherein the chair is a freely collapsible chair.

* * * * *